US006783107B2

(12) United States Patent
Chatufale

(10) Patent No.: US 6,783,107 B2
(45) Date of Patent: Aug. 31, 2004

(54) HYDRAULIC ACTUATOR WITH BUILT-IN PRESSURE COMPENSATOR

(75) Inventor: Vijay Chatufale, Missouri City, TX (US)

(73) Assignee: HP&T Products, Inc., Stafford, TX (US)

( * ) Notice: Subject to any disclaimer, the term of this patent is extended or adjusted under 35 U.S.C. 154(b) by 146 days.

(21) Appl. No.: 10/194,871

(22) Filed: Jul. 12, 2002

(65) Prior Publication Data

US 2002/0175303 A1 Nov. 28, 2002

Related U.S. Application Data

(60) Provisional application No. 60/356,953, filed on Feb. 14, 2002.

(51) Int. Cl.[7] ..... F18K 31/12

(52) U.S. Cl. ..... 251/54; 251/63.5; 251/63.6

(58) Field of Search ..... 251/54, 63.5, 63.6; 91/4 R

(56) References Cited

U.S. PATENT DOCUMENTS 4,423,748 A * 1/1984 Ellett ..... 137/315.29
4,934,652 A * 6/1990 Golden ..... 251/63.6
5,166,677 A * 11/1992 Schoenberg ..... 340/853.3
6,041,804 A 3/2000 Chatufale

* cited by examiner

*Primary Examiner*—Edward K. Look
*Assistant Examiner*—John K. Fristoe, Jr.
(74) *Attorney, Agent, or Firm*—Slater & Matsil, L.L.P.

(57) ABSTRACT

A hydraulic actuator (20) with a built-in hydrostatic pressure compensator (111) is provided. The actuator (20) includes an actuator housing (30), a compensator cylinder portion (86), a compensator piston portion (94), a first compensator piston chamber (98), a second compensator piston chamber (103), a hydraulic port (106), and a hydraulic via (108). The compensator cylinder portion (86) is located within the actuator housing (30), is fixed relative to the housing (30), and has a compensator cylinder internal chamber (88) formed therein. The compensator piston portion (94) slidably fits within the compensator cylinder internal chamber (88). The first compensator piston chamber (98) is formed between a first side (101) of the compensator piston portion (94) and the compensator cylinder portion (86). The second compensator piston chamber (103) is formed between a second side (102) of the compensator piston portion (94) and the compensator cylinder portion (86). The hydraulic port (106) is routed through the housing (30) and opens to the first compensator piston chamber (98). The hydraulic via (108) fluidly couples the second compensator piston chamber (103) with a first housing internal chamber (82).

39 Claims, 5 Drawing Sheets

HYDRAULIC ACTUATOR WITH BUILT-IN PRESSURE COMPENSATOR

This application claims priority under 35 U.S.C. §119(e) (1) of Provisional Application Ser. No. 60/356,953 filed on Feb. 14, 2002, which is incorporated herein by reference.

TECHNICAL FIELD

The present invention relates generally to equipment used in oilfield and, more particularly, to a hydraulic actuator for a valve.

BACKGROUND

Hydraulic actuators are used in the petroleum industry to open and close valves. Subsea actuators are used to operate valves for pipelines and drilling operations under water. A prior art actuator 2 is shown in schematic form in FIG. 1A. The actuator 2 is coupled to and adapted to control a valve 8 for a pipeline 9. The actuator 2 is coupled to a control system 6 which may comprise a hydraulic three-way valve, for example. The actuator 2, control system 6 and hydraulic lines coupled therebetween are submerged in seawater. A hydrostatic head 7 comprises pressure generated due to the height of the fluid column at a given depth under the water surface 5. For example, the hydrostatic head 7 generated by seawater at 10,000 feet depth is 0.433 p.s.i./foot×10,000 feet=4,333 p.s.i. The amount of pressure generated is dependent on the type of fluid in the column. For example, hydraulic fluid generates less pressure than seawater. Hydraulic fluid may be pumped into the control system 6 through a hydraulic control line coupled from the water surface 5 to the control system 6 at an input port I.

The actuator 2 includes a spring 4 adapted to exert pressure on a piston 3. The piston 3 may be sealed with o-rings inside the actuator housing. The control system 6 is coupled to the actuator 2 at port P1 in a region above the piston 3, and also is coupled to the actuator 2 at port P2 in a region below the piston 3, for example, with hydraulic lines. Hydraulic fluid may be sent from the control system 6 to actuator port P1 to move the piston 3 down. Similarly, hydraulic fluid may be sent from the control system to actuator port P2 to move the piston 3 up.

The control system 6 also includes a vent V into the sea where excess hydraulic fluid may be leaked out. For example, when the piston 3 goes up, the control system 6 dumps a corresponding volume of hydraulic fluid into the sea through the vent V. When in a vent mode, the control system 6 communicates with the seawater, and the hydraulic fluid within the control system 6 may become contaminated with seawater. Seawater, which contains corrosive chemicals such as chlorides, for example, can enter the spring chamber 12 of the actuator 2 and corrode the spring 4 and other parts of the actuator 2. If the spring 4 corrodes, this can cause failure of the actuator 2. Because the spring 4 is typically the most mechanically stressed component in the actuator 2, corrosion of the spring 4 may cause the spring 4 to fracture into a number of pieces. Failure of the spring 4 usually renders the actuator 2 inoperable for controlling a gate valve 8.

Furthermore, a hydraulic line from the control system must be provided into port P2 to supply a hydrostatic head underneath the piston 3 in order to achieve equilibrium. Each actuator 2 in use under the sea requires one hydraulic line from the control panel 6. In subsea applications, there are a limited number of hydraulic lines available for use.

As described above, prior art actuators 2 are not designed to accept seawater inside, which can corrode various components such as the spring 4. In an attempt to prevent seawater from entering hydraulic actuators, an external pressure compensator 10 can be coupled between the control system 6 and port P2 of the actuator 2, as shown in FIG. 1B. The external pressure compensator 10, also referred to herein as a piston accumulator or piston accumulator system, is a separate component from the actuator 2 and provides hydrostatic pressure compensation of hydraulic fluid displaced within the actuator 2 during operation. The pressure compensator 10 prevents seawater-contaminated hydraulic fluid from the control system 6 from entering port P2 in the actuator spring chamber 12, thus preventing corrosion of the spring 4.

However, external pressure compensators 10 are typically attached to the actuator 2 by brackets (not shown), for example, and are fluidly coupled to the actuator 2 by piping at P2. The connection joints of the piping provide potential leak sites, which may affect the reliability of the actuator system. Thus, a need exists for an actuator and compensator package that has fewer potential leak sites, to improve the reliability of the system.

Furthermore, using an external pressure compensator 10 is disadvantageous in that an additional component and installation is required, requiring increased cost and labor. Reliance on an additional manufacturer (e.g. for the pressure compensator 10) is required, and more engineering is required, to select the size, pressure rating and availability of the external compensator. Clamping and mounting the compensator 10 with the actuator 2 can be problematic, requiring more connections and leading to more leakage paths, so that a chance of seawater entering the spring chamber 12 is created.

The use of an external pressure compensator 10 also increases the space required. There may be space restrictions at the installation site for the actuator 2 that may make it difficult or unfeasible to use an actuator 2 with an external pressure compensator 10.

SUMMARY OF THE INVENTION

Embodiments of the present invention achieve technical advantages as a hydraulic actuator with a built-in pressure compensator. Hydraulic fluid that is possibly contaminated with seawater is prevented from entering the chamber containing the spring, preventing corrosion of the spring and extending the usable life of the actuator.

In accordance with one aspect of the present invention, a hydraulic actuator includes an actuator housing, a built-in pressure compensator, a first housing internal chamber, and a first hydraulic via. The built-in pressure compensator is located within the housing. The built-in pressure compensator includes a compensator cylinder portion, a compensator piston portion, a first compensator piston chamber, a second compensator piston chamber, and a compensator hydraulic port. The compensator cylinder portion is located within the actuator housing. The compensator cylinder portion is fixed relative to the housing and has an internal chamber formed therein. The compensator piston portion slidably fits within the compensator internal chamber.

The first compensator piston chamber is formed between a first side of the compensator piston portion and the compensator cylinder portion within the compensator internal chamber. The second compensator piston chamber is formed between a second side of the compensator piston portion and the compensator cylinder portion within the compensator internal chamber. The compensator hydraulic port is routed through the housing, with one end opening outside of the housing and the other end opening to the first compensator piston chamber. The first housing internal chamber is formed within the housing. The first hydraulic via is formed through the compensator cylinder portion, fluidly coupling the second compensator piston chamber with the first housing internal chamber.

In accordance with another aspect of the present invention, a hydraulic actuator is provided, which includes a housing, an operating stem, a first cylinder portion, a first housing internal chamber, a second housing internal chamber, a spring, a first piston portion, a first piston chamber, a second cylinder portion, a second piston portion, a second piston chamber, a third piston chamber, a first hydraulic port, a second hydraulic port, a first hydraulic via, and a second hydraulic via. The operating stem extends into the housing and is slidably coupled to the housing. The first cylinder portion slidably fits within the housing and has a first cylinder internal chamber formed therein with a closed end and an open end. The first cylinder portion is mechanically coupled to the operating stem. The first housing internal chamber is formed within the housing between the housing and the first cylinder portion at the open end of the first cylinder internal chamber, such that the first cylinder internal chamber of the first cylinder portion opens to the first housing internal chamber. The second housing internal chamber is formed within the housing between the housing and an exterior of the first cylinder portion. The spring is located within the housing and is biased between the housing and the first cylinder portion. The first piston portion is located within the housing, is fixed relative to the housing, extends through the open end of the first cylinder internal chamber, and slidably fits into the first cylinder internal chamber of the first cylinder portion. The first piston chamber is formed between the first piston portion and the first cylinder portion within the first cylinder internal chamber. The second cylinder portion is located within the housing and is fixed relative to the housing. The second cylinder portion has a second cylinder internal chamber formed therein. The second piston portion is located within the housing and slidably fits within the second cylinder internal chamber. The second piston chamber is formed between a first side of the second piston portion and the second cylinder portion within the second cylinder internal chamber. The third piston chamber is formed between a second side of the second piston portion and the second cylinder portion within the second cylinder internal chamber. The first hydraulic port routes through the first piston portion and the housing, with one end opening outside of the housing and another end opening to the first piston chamber. The second hydraulic port routes through the housing, with one end opening outside of the housing and another end opening to the second piston chamber. The first hydraulic via is formed through the second cylinder portion and fluidly couples the third piston chamber with the first housing internal chamber. The second hydraulic via is formed through the first cylinder portion and fluidly couples the first housing internal chamber with the second housing internal chamber.

In accordance with another aspect of the present invention, a method of manufacturing an actuator is disclosed. The method includes providing an actuator housing, and disposing a compensator cylinder portion within the actuator housing, the compensator cylinder portion being fixed relative to the housing and having a compensator internal chamber formed therein. A compensator piston portion is slidably fitted within the compensator internal chamber, wherein a first compensator piston chamber is formed between a first side of the compensator piston portion and the compensator cylinder portion, and wherein a second compensator piston chamber is formed between a second side of the compensator piston portion and the compensator cylinder portion. A hydraulic port is formed through the housing such that the hydraulic port opens to the first compensator piston chamber. A hydraulic via is formed through the compensator cylinder portion to fluidly couple the second compensator piston chamber with the first housing internal chamber. The compensator cylinder portion, compensator piston portion, hydraulic port and hydraulic via comprise a built-in pressure compensator.

Advantages of embodiments of the invention include providing a space-saving actuator with a pressure compensator built into the housing. Installation of the actuator to a valve is simplified, and no external accumulator unit is required. Because no external piping joints are required to connect the built-in compensator to the actuator, the actuator has fewer potential leak sites.

BRIEF DESCRIPTION OF THE DRAWINGS

The above features of the present invention will be more clearly understood from consideration of the following descriptions in connection with accompanying drawings in which.

DETAILED DESCRIPTION OF PREFERRED EMBODIMENTS

Figure 1A:
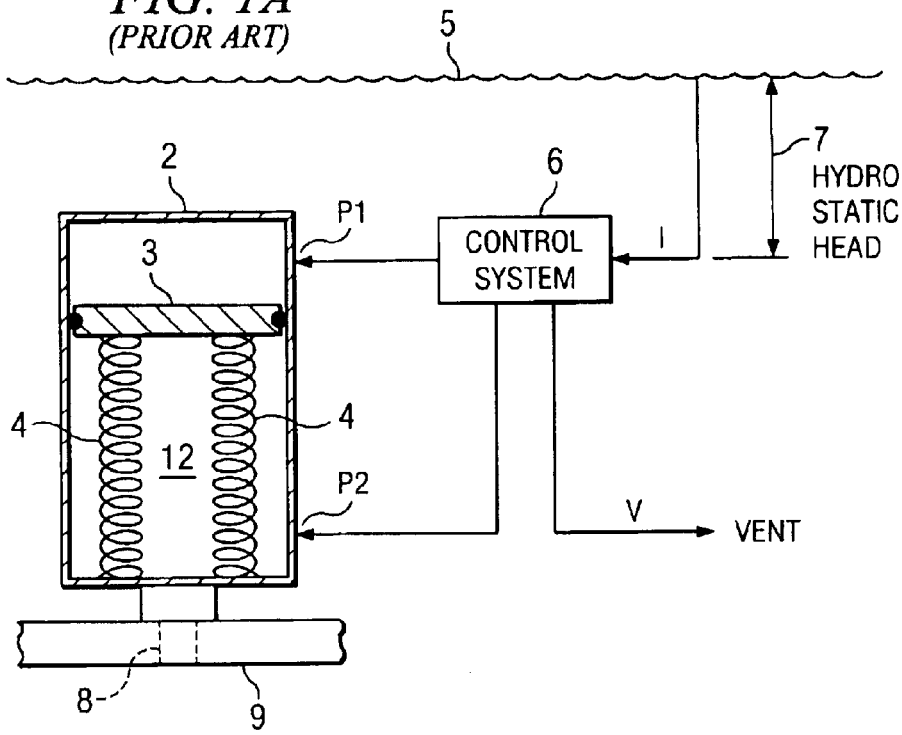
FIG. 1A (PRIOR ART)
FIG. 1A shows a schematic diagram of a prior art subsea actuator system.
Figure 1B:
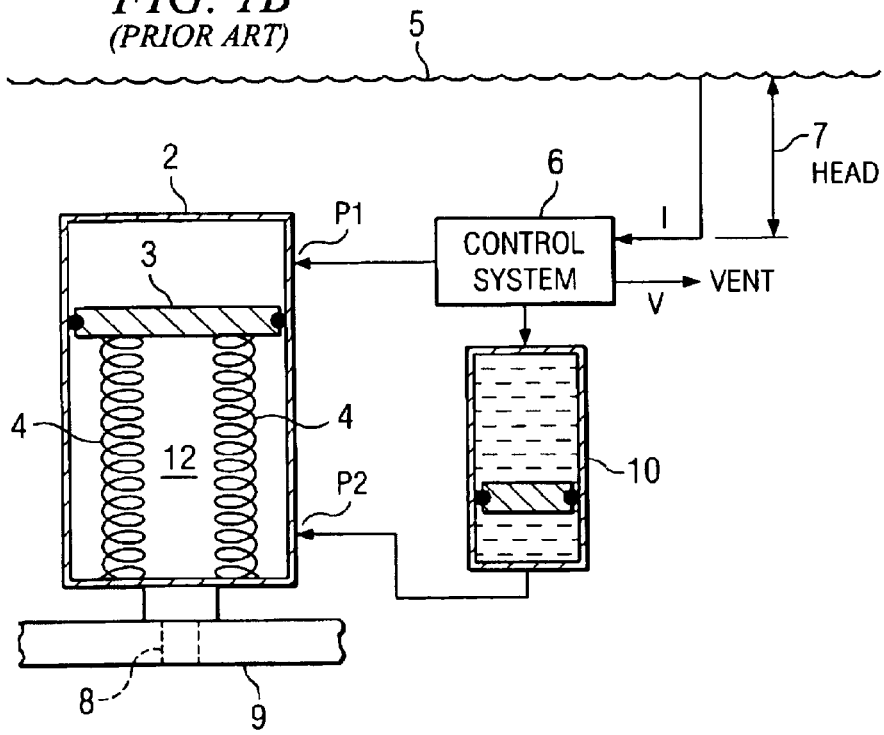
FIG. 1B (PRIOR ART)
FIG. 1 B shows a schematic diagram of a prior art subsea actuator system having an external pressure compensator.

Referring now to the drawings, wherein like reference numbers are used herein to designate like elements throughout the various views, a preferred embodiment of the present invention is illustrated and described. As will be understood by one of ordinary skill in the art, the figures are not necessarily drawn to scale, and in some instances the drawings have been exaggerated and/or simplified in places for illustrative purposes only. One of ordinary skill in the art will appreciate the many applications and variations of the present invention in light of the following description of the preferred embodiment of the present invention. Preferred embodiments of the present invention will be described, followed by a discussion of some advantages thereof.

Generally, an embodiment of the present invention provides a hydraulic actuator with a built-in hydrostatic compensator. The following description and FIGS. 2–5 pertain to a preferred embodiment of the present invention. The preferred embodiment discussed herein is but one illustrative example of the present invention and does not limit the scope of the invention to the preferred embodiment described.

Figure 2:
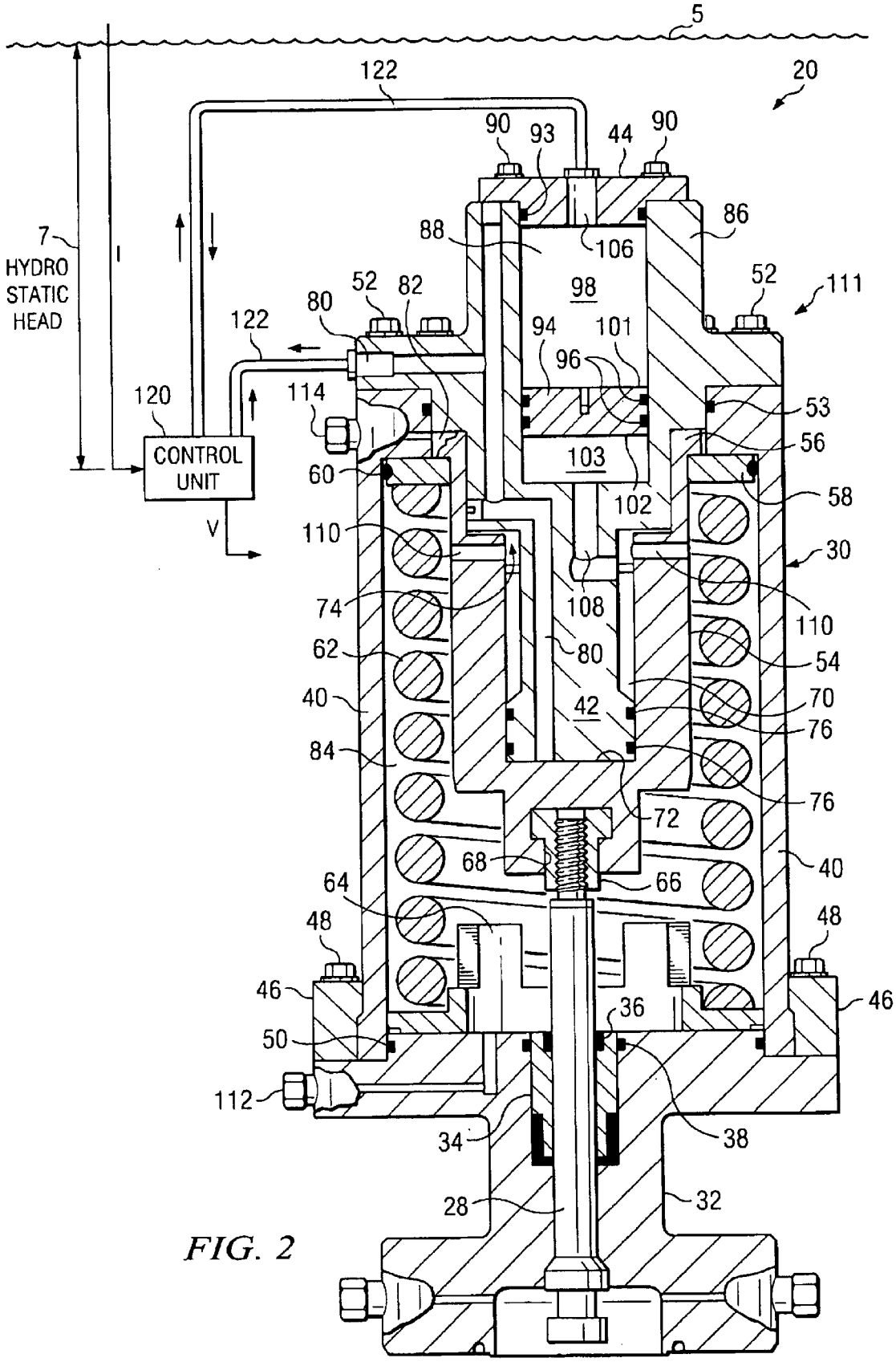
FIG. 2 is a cut-away side view of a preferred embodiment of the present invention having a built-in pressure compensator, with the first cylinder portion in a first position.
Figure 3:
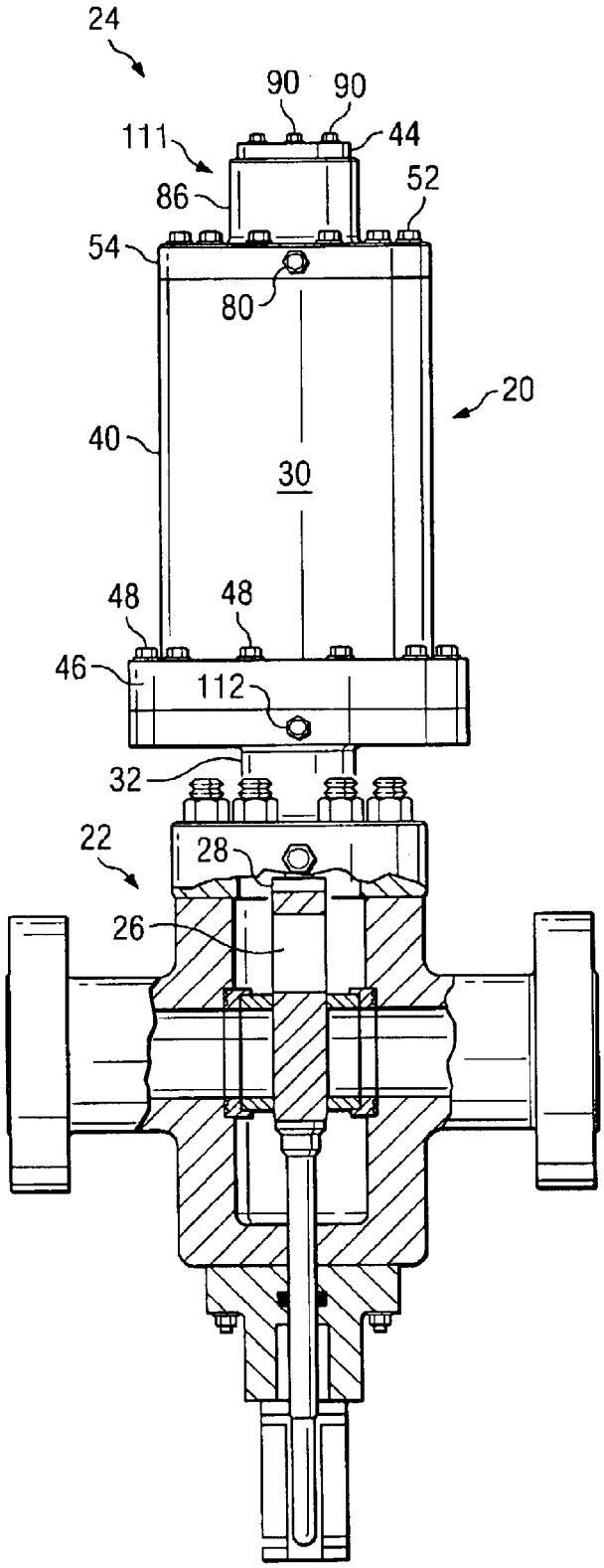
FIGS. 3 and 4 show the preferred embodiment of the invention attached to a valve.
Figure 4:
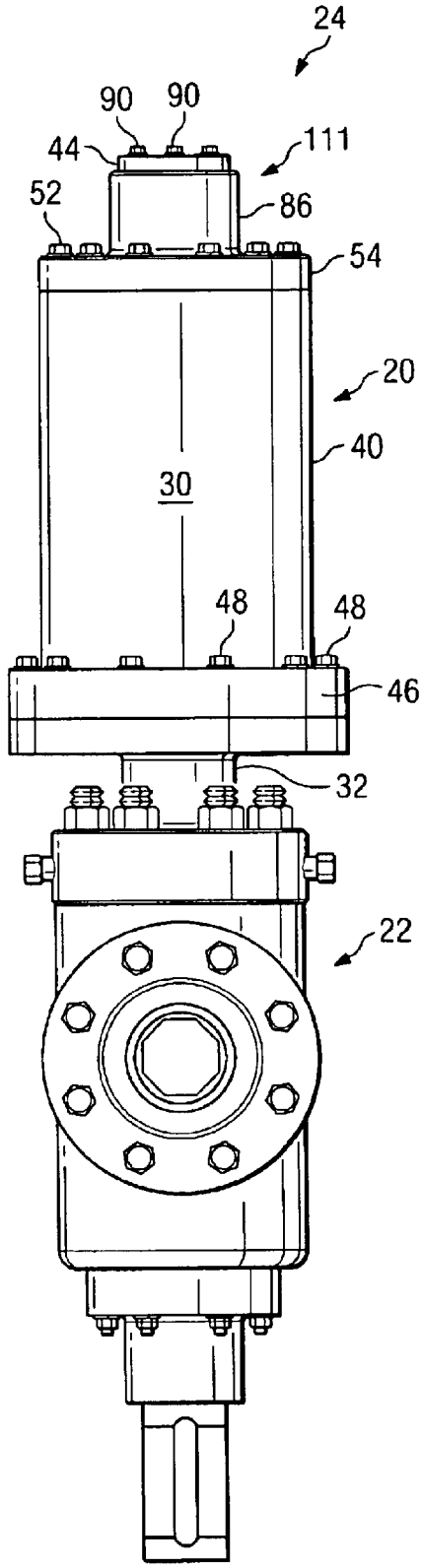

FIG. 2 shows a cut-away side view of a hydraulic actuator 20 including a built-in compensator 111 in accordance with a preferred embodiment of the present invention. The actuator 20 of the preferred embodiment is adapted to fit onto a valve assembly 22, as shown in FIGS. 3 and 4. In this example, the valve/actuator combination 24 shown in FIGS. 3 and 4 is adapted for use in subsea petroleum production. Hence, the actuator 20 drives the movement of a valve 26 (e.g., a gate valve) in the valve assembly 22 as needed to control the flow of a fluid, such as petroleum, flowing through the valve 26 via a pipeline (not shown) fluidly coupled to the valve assembly 22.

As shown in FIG. 2, an operating stem 28 extends into the housing 30 and is slidably coupled to the housing 30 at a bonnet portion 32 of the housing 30. Hence, the operating stem 28 is able to slide up and down within the bonnet portion 32. During use of the actuator 20, the actuator 20 drives the operating stem 28 down (or up) and the operating stem 28 in turn opens (or closes) the valve 26 (see valve 26 in FIG. 3). The operating stem 28 is laterally supported by the bonnet portion 32. A packing gland 34 fits within the bonnet portion 32 about the operating stem 28. A first seal ring 36 is disposed between the packing gland 34 and the operating stem 28, and a second seal ring 38 is disposed between the packing gland 34 and the bonnet portion 32.

The housing 30 of the actuator 20 is filled with hydraulic fluid and contains most components of the actuator 20 therein. For purposes of this description, the housing 30 includes all of the components that fit together to contain hydraulic fluid within the actuator 20, which may vary for different embodiments with different configurations. In accordance with a preferred embodiment, the housing 30 includes the bonnet portion 32, an outer sidewall portion 40, a first piston portion 42, a cover plate 44, and numerous seals. The outer sidewall portion 40 is preferably cylindrical shaped, but may comprise other shapes, for example. A housing retainer ring 46 may fasten the outer sidewall portion 40 to the bonnet portion 32. The housing retainer ring 46 may have a plurality of bolt holes formed around it to receive a set of cap screws 48, which thread into the bonnet portion 32. In other embodiments, there may be no retainer ring 46, or the retainer ring 46 may be integral with the outer sidewall portion 40, for example. A first seal 50 may be disposed between the outer sidewall portion 40 and the bonnet portion 32. At the top portion of the housing 30, the first piston portion 42, also referred to herein as an actuator piston portion, is bolted onto the outer sidewall portion 40 with cap screws 52. A second seal 53 may be disposed between the first piston portion 42 and the outer sidewall portion 40.

A first cylinder portion 54, also referred to herein as an actuator cylinder portion, slidably fits within the housing 30. In the preferred embodiment, the first cylinder portion 54 has a flange 56 extending from its exterior and at its top end. A separate spring plate ring 58 fits about the exterior of the first cylinder portion 54 and abuts against the flange 56. Alternatively, the spring plate ring 58 may be an integral part of the first cylinder portion 54, for example. A fourth seal 60 may be disposed between the spring plate ring 58 and the outer sidewall portion 40 of the housing 30.

A coil spring 62 is disposed about the first cylinder portion 54. The spring 62 is biased between the first cylinder portion 54 and the housing 30. In the preferred embodiment, the housing 30 has a separate stop ring 64 located therein on top of the bonnet portion 32. In this example, the spring 62 is biased against the spring plate ring 58 at one end and the stop ring 64 at the other end. The stop ring 64 limits the downward travel of the first cylinder portion 54 within the housing 30. In other embodiments, the stop ring 64 may be an integral part of the housing 30, for example. The first cylinder portion 54 may be coupled to the operating stem 28 by a T-nut arrangement. For example, a T-shaped nut 66 may be threaded onto the operating stem 28, and the first cylinder portion 64 may have a corresponding slot 68 with a T-shaped cross-section that the T-nut 66 slidably fits into.

The first cylinder portion 54 has a first cylinder internal chamber 70 formed therein, which has a closed end 72 at its bottom and an open end 74 at its top. The first piston portion 42 is preferably fixed relative to the housing 30 and extends downward through the open end 74 of the first cylinder internal chamber 70 and into the first cylinder internal chamber 70. The first piston portion 42 slidably fits within the first cylinder internal chamber 70. A first set of piston ring seals 76 may be disposed between the first piston portion 42 and the first cylinder portion 54 such that a first piston chamber 78 (not shown in FIG. 2; see FIG. 5) is formed between the first piston portion 42 and the first cylinder portion 54 at the closed end 72 of the first cylinder internal chamber 70. The piston ring seals 76 preferably comprise unidirectional seals adapted to seal in one direction. The piston chamber 78 is also referred to herein as an actuator piston chamber. A first hydraulic port 80 is formed in and routes through the housing 30 and the first piston portion 42. One end of the first hydraulic port 80 opens outside of the housing 30 and may be coupled to a piper or a hydraulic valve, for example. Another end of the first hydraulic port 80 opens to the first piston chamber 78. Hence, hydraulic fluid may enter and exit the first piston chamber 78 via the first hydraulic port 80.

Figure 5:
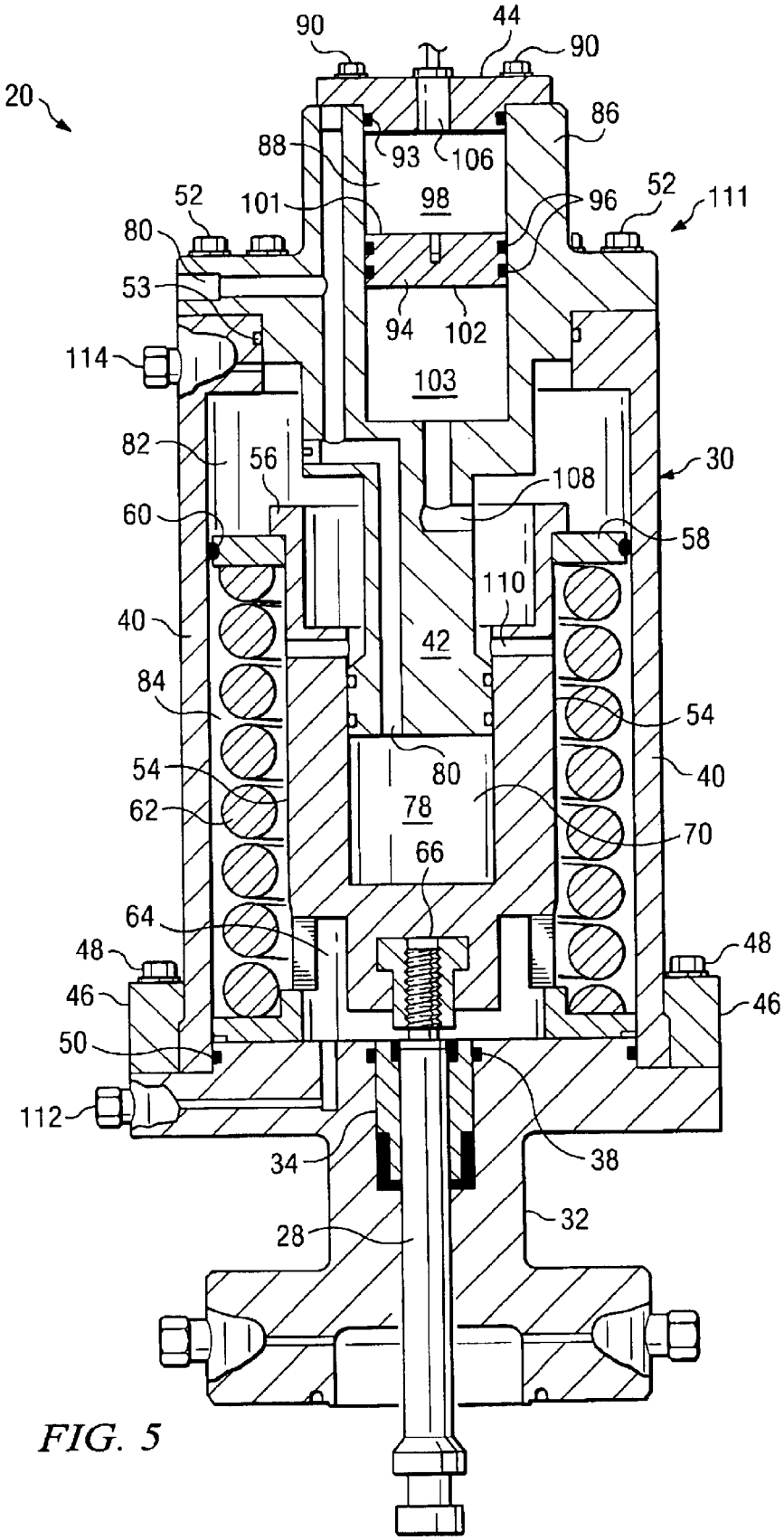
FIG. 5 is a cut-away view of the preferred embodiment with the first cylinder portion in a second position.

As best seen in FIG. 5 with the first cylinder portion 54 pressed down, a first housing internal chamber 82 is formed within the housing 30 between the housing 30 and the first cylinder portion 54 at the open end 74 (FIG. 2) of the first cylinder internal chamber 70. Referring again to FIG. 2, the first set of piston rings 76 isolates hydraulic fluid within the first piston chamber 78 from hydraulic fluid within the first housing internal chamber 82, as well as the hydraulic fluid in the other parts of the actuator 20. A second housing internal chamber 84 is formed within the housing 30 between the housing 30 and the exterior of the first cylinder portion 54.

For the preferred embodiment, a second cylinder portion 86, also referred to herein as a compensator cylinder portion, is integrally formed within the first piston portion 42 and within the housing 30. Hence, the second cylinder portion 86 remains fixed relative to the housing 30 during use of the actuator 20. The second cylinder portion 86 has a second cylinder internal chamber 88, also referred to herein as a compensator cylinder internal chamber, formed therein, which is closed at its top end by the cover plate 44 in this embodiment. The cover plate 44 may be bolted onto the top of the second cylinder portion 86 with cap screws 90, for example, although other connection means may be used. A third seal 93 may be disposed between the cover plate and the second cylinder portion 86.

A second piston portion 94, also referred to herein as a compensator piston portion, slidably fits within the second cylinder internal chamber 88. For example, the second piston portion 94 is able to slide up and down within the second cylinder portion 86. A second set of piston rings 96 are preferably disposed on the second piston portion 94, wherein the second set of piston rings 96 divide the second cylinder internal chamber 88 into two parts. Hence, a second piston chamber 98 is formed between a first side 101 (i.e., the top side in this example) of the second piston portion 94 and the second cylinder portion 86 within the second cylinder internal chamber 88. The second piston chamber 98 is also referred to herein as a first compensator piston chamber. A third piston chamber 103 is formed between a second side 102 (i.e., the bottom side in this example) of the second piston portion 94 and the second cylinder portion 86 within the second cylinder internal chamber 88. The third piston chamber 103 is also referred to herein as a second compensator piston chamber.

While many components of the actuator 20, such as operating stem 28, housing 30, packing gland 34, first piston portion 42, first cylinder portion 54, second piston portion 94, second cylinder portion 86, cover plate 44, retainer ring 46, and cap screws 48/52, as examples, preferably comprise steel, they may alternatively comprise other metals and materials suitable for the pressure and temperature the actuator 20 will be exposed to during operation. The various seals 36, 38, 50, 53, 60, 93 and piston rings 76 and 96 preferably comprise an elastomeric material, and may alternatively comprise a variety of shapes, configurations, and materials, such as C-shaped seal rings, U-shaped seal rings, carbon-filled polytetraflouroethylene (PTFE), polyetheretherketone (PEEK), polyethersulfone (PES), heat-resistant thermoplastic, polyphenol sulfide (e.g., Ryton™), sprung metal, or mechanically alloyed metal (e.g., Inconel™ made by Inco Alloys International, Inc.), as examples.

A second hydraulic port 106 is formed in and routed through the housing 30 at the cover plate 44. One end of the second hydraulic port 106 opens outside of the housing 30 and another end opens to the second piston chamber 98. A first hydraulic via 108 is formed in and routed through the second cylinder portion 86 (as well as through part of the first piston portion 42 in this case). The first hydraulic via 108 fluidly couples the third piston chamber 103 to the first housing internal chamber 82 (best shown in FIG. 5). At least one second hydraulic via 110 is formed in and routed through the first cylinder portion 54. The second hydraulic via 110 fluidly couples the first housing internal chamber 82 with the second housing internal chamber 84. In accordance with a preferred embodiment, four second hydraulic vias 110 are disposed about the first cylinder portion 54; however, the number and size of the second hydraulic via(s) 10 may vary for different actuators, and may be designed and tuned to provide the desired flow characteristics. Similarly, the number and size of the first hydraulic via(s) 108 may vary for different actuators, and may be designed and tuned to provide the desired flow characteristics. Thus, a built-in hydrostatic pressure compensator 111 is formed within the actuator 20. Preferably, the hydraulic vias 108, 110 and ports 80, 106 are sized to have minimal hydraulic restrictions.

In the preferred embodiment, the actuator 20 includes a lower filling port 112 formed in the bonnet portion 32, which opens to the second housing internal chamber 84. The actuator 20 also includes an upper filling port 114 formed in the outer sidewall portion 40, which opens to the first housing internal chamber 82. The filling ports 112, 114 are used to fill the actuator 20 with hydraulic fluid and may be plugged closed during use of the actuator 20.

In preparing the actuator 20 of the preferred embodiment for operation, the following sequence may be followed. First, the cover plate 44 is removed. Next, the second piston portion 94 is removed by threading a rod (not shown) into a threaded hole formed in the top of the second piston portion 94. The second piston portion 94 is then pulled from the second cylinder portion 86 using the rod. Third, with the upper filling port 114 plugged closed, hydraulic fluid is pumped into the actuator 20 through the lower filling port 112 until the second cylinder internal chamber 88 is filled, at which point, the housing 30 is thus filled with hydraulic fluid. Fourth, the lower filling port 112 is plugged off and the upper filling port 114 is opened just enough to allow fluid leakage (i.e., for bleeding the actuator 20). Fifth, the second piston portion 94 is then installed back into the second cylinder portion 86 and pushed down to a preset level within the second cylinder portion 86. As the second piston portion 94 is pushed down, excess hydraulic fluid is bled out of the upper filling port 114. Sixth, when the preset level is reached, the upper filling port 114 is plugged closed. Seventh, hydraulic fluid is added in the second cylinder internal chamber 88 on top of the second piston portion 94 until the second piston chamber 98 is full. Eight, the cover plate 44 may be reinstalled with a new seal 93 (if needed). Thus, at this point the entire actuator 20 has been filled with hydraulic fluid and the actuator 20 is ready for use.

Referring now to FIGS. 2 and 5, the operation of the actuator 20 having a built-in pressure compensator 111 will be briefly described. FIG. 2 schematically shows an external pressure source and control unit 120, which is fluidly coupled to the actuator 20 by piping 122. The control unit 120 or control system includes an input port I and a vent port V. A hydraulic line running to the water surface 5 is coupled to the control unit input port I. The control unit 120 is adapted to provide two-way flow of hydraulic fluid within the piping 122 for the actuator as needed for input and output of hydraulic fluid to and from the actuator 20. Note that there is no external flow into or out of the first and second housing internal chambers 82 and 84.

FIG. 2 shows the actuator 20 with the first cylinder portion 54 in a first position, which in this case is a closed position for the valve 26 connected to the actuator 20 (see FIG. 3). In the first position, the spring 62 is free to push the first cylinder portion 54 to its upper limit within the housing 30, which in turn pulls the operating stem 28 up, as well as the valve 26 coupled to the operating stem 28. When pressurized hydraulic fluid is pumped into the first piston chamber 78 through the first hydraulic port 80 and the downward force of the hydraulic pressure is enough to compress the spring 62, the first cylinder portion 54 slides downward within the housing 30. The downward displacement of the first cylinder portion 54 in turn pushes the operating stem 28 down, which in turn actuates the valve 26 to an open position.

FIG. 5 shows the actuator 20 with the first cylinder portion 54 in a second position, which corresponds to the valve 26 being fully open in this case. The stop ring 64 limits the downward displacement of the first cylinder portion 54. As the first cylinder portion 54 moves downward, hydraulic fluid within the second housing internal chamber 84 is displaced into the first housing internal chamber 82 through the second hydraulic vias 110. However, because the first and second housing internal chambers 82 and 84 are sealed to the exterior, the excess volume of fluid within the housing 30 (i.e., the volume added into the housing 30 by the hydraulic fluid being pumped into the first piston chamber 78) must be displaced somewhere. Hence, this is where the need for the compensator 111 arises. Because the first housing internal chamber 82 is not large enough to contain the volume of hydraulic fluid displaced from the second housing internal chamber 84, when the first cylinder portion 54 is pressed down, hydraulic fluid from the first housing internal chamber 82 is displaced into the third piston chamber 103 through the first hydraulic via 108, i.e., into the built-in hydrostatic compensator 111. As hydraulic fluid enters the third piston chamber 103, the second piston portion 94 is pushed upward within the second cylinder internal chamber 88. The upward displacement of the second piston portion 94 displaces hydraulic fluid in the second piston chamber 98 out of the actuator 20 through the second hydraulic port 106. Note that hydraulic fluid in the second piston chamber 98 is sealed from hydraulic fluid in the third piston chamber 103 by the second set of piston rings 96. Only hydraulic fluid pumped into and out of the first piston chamber 78 via the first hydraulic port 80 and hydraulic fluid pumped into and out of the second piston chamber 98 via the second hydraulic port 106 enters and leaves the actuator 20 during use of the actuator 20. Thus, the hydraulic fluid that the spring 62 is submerged in never leaves the actuator 20; it is merely shifted to other locations. This provides an advantage of preventing the hydraulic fluid that the spring 62 is submerged in from being contaminated by external elements (e.g., salt water) because it remains self-contained and sealed within the housing 30.

When the hydraulic pressure is released and/or a hydraulic valve (not shown) connected to the first hydraulic port 80 is opened, the spring 62 drives the first cylinder portion 54 upward, which in turn closes the valve 26. The upward movement of the first cylinder portion 54 pulls hydraulic fluid from the third piston chamber 103 and the first housing internal chamber 82 back into the second housing internal chamber 84, which pulls the second piston portion 94 back down to the preset level. As this happens, hydraulic fluid is pumped back into the second piston chamber 98 through the second hydraulic port 106. Alternatively, a hydraulic valve (not shown) may be connected to the second hydraulic port 106 to allow hydraulic fluid to be drawn in the second hydraulic port 106, to refill the second piston chamber 98 as the second piston portion 94 moves downward.

In another embodiment, the actuator 20 may be configured so that the spring 62 may be assisted in pushing the first cylinder portion 54 upward. For example, hydraulic pressure may be applied to the second hydraulic port 106 and into the second piston chamber 98 to hydraulically assist the spring 62 in moving the first cylinder portion 54.

Because in the preferred embodiment described herein the spring 62 forces the valve 26 to close when there is no hydraulic pressure on the actuator 20, the preferred embodiment comprises a fail-safe actuator. In yet another embodiment of the present invention (not shown), the actuator 20 does not include a spring 62 to push the first cylinder portion 54 upward, and thus such an embodiment is not a failsafe actuator. In a non-failsafe embodiment of the present invention, the first cylinder portion 54 may be driven upward by hydraulic pressure applied in the second piston chamber 98 through the second hydraulic port, for example. Embodiments of the present invention may provide a failsafe closed or a failsafe open configuration to suit a given application.

Figure 6:
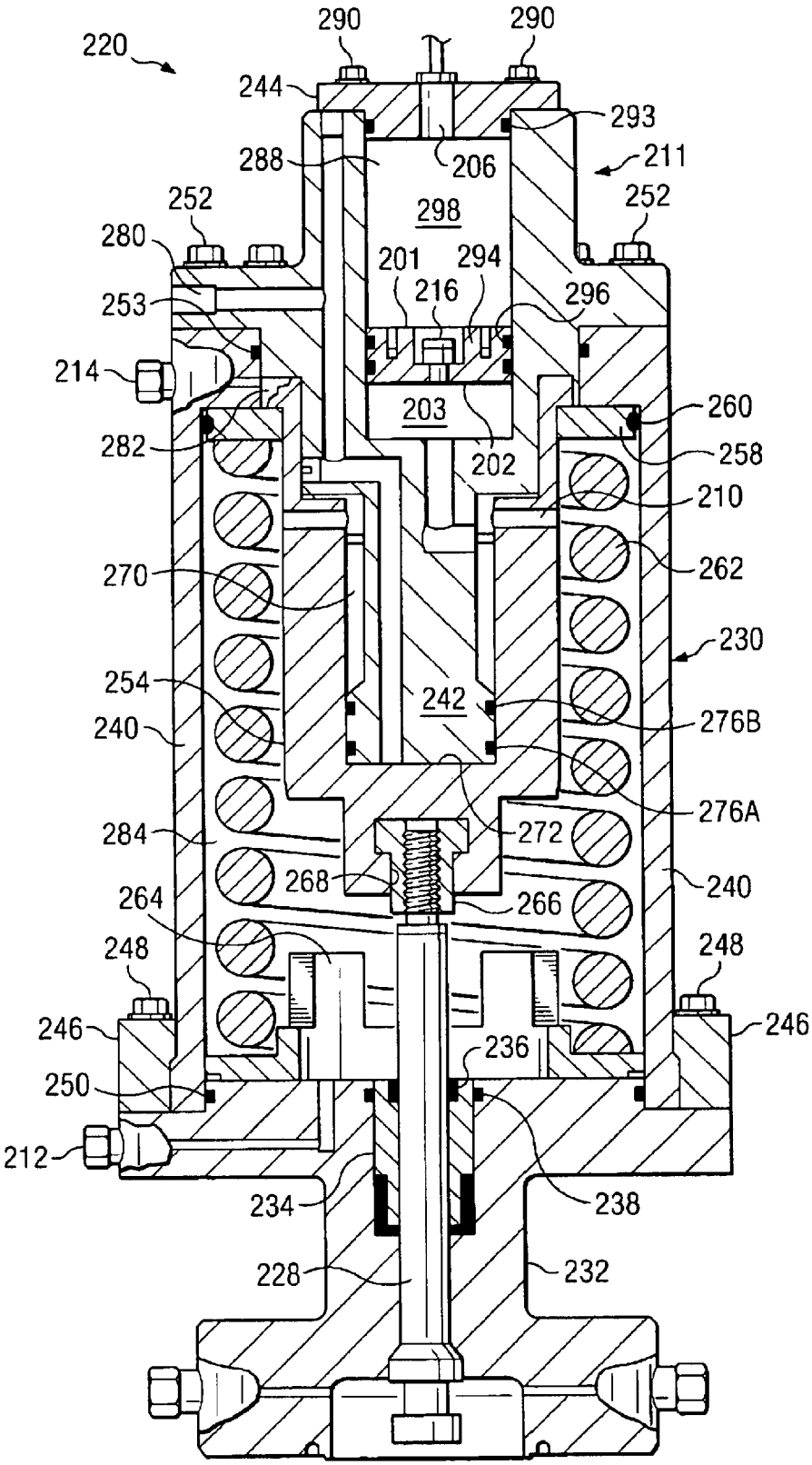
FIG. 6 shows a cut-away view of another preferred embodiment of the present invention, which includes a built-in compensator having a relief valve in the piston.

An actuator 220 in accordance with another embodiment of the present invention is shown in a cut-away view in FIG. 6, with like numerals being used for the elements labeled in FIGS. 2 and 5. Actuator 220 includes a relief valve 216 disposed within the built-in compensation piston 211. More particularly, the relief valve 216 is disposed within second piston portion 294, as shown. The relief valve 216 is coupled to the compensator piston portion 294, wherein the relief valve 216 is fluidly coupled to the second compensator piston chamber 203. The relief valve 216 is preferably adjustable and may be adjusted between to about 100 to 400 psi, for example. Alternatively, the relief valve 216 may have a fixed pressure setting, e.g., up to 150 psi, as an example.

Piston ring seals 276A and 276B preferably comprise unidirectional seals adapted to seal in one direction. Piston ring seal 276A preferably seals towards the first cylinder portion 254, and piston ring seal 276B preferably seals away from the first cylinder portion 254. In operation, piston ring seal 276A seals the pressure coming in from the first hydraulic port 280, and assists in pushing the first cylinder portion 254 and operating stem 228 down, to open the valve (not shown in FIG. 6; see FIG. 3). Piston ring seal 276B is adapted to seal pressure from the second housing internal chamber 284, and senses the hydrostatic head pressure from the compensating chamber, namely, third piston chamber 203.

If piston ring seal 276A fails, the pressure from the open or first hydraulic port 280 begins entering the second housing internal chamber 284, which contains the spring 262. Because piston ring seal 276B comprises a unidirectional seal, the seal 276B allows pressure from behind to enter into the second housing internal chamber 284. The pressure relief valve 216 is adapted to allow the hydraulic fluid pressure to build up to the amount the relief valve is set for. Upon reaching its pressure limit, the relief valve 216 pops open and allows the excess hydraulic fluid pressure to vent outwards, e.g., through hydraulic port 206, towards the sea. Therefore, the relief valve 216 provides improved safety of the actuator 220 having a built-in compensator 211.

Embodiments of the present invention include a method of producing petroleum, comprising coupling the actuator 20 described herein to a valve 26 (FIG. 3) and controlling the flow of a fluid, such as petroleum, through the valve 26 using the actuator 20 during production operations.

Embodiments of the present invention also include a method of compensating for pressure changes and hydraulic fluid displacement within an actuator, comprising providing an actuator 20 including a built-in pressure compensator 111 described herein, inputting hydraulic fluid into the actuator 20, and compensating for pressure changes and hydraulic fluid displacement within the actuator 20 using the built-in pressure compensator 111.

Referring again to FIG. 2, embodiments of the present invention further include a method of manufacturing an actuator 20, comprising providing an actuator housing 30, disposing a compensator cylinder portion 86 within the actuator housing 30, the compensator cylinder portion 86 being fixed relative to the housing 30 and having a compensator cylinder internal chamber 88 formed therein. The method includes slidably fitting a compensator piston portion 94 within the compensator cylinder internal chamber 88, wherein a first compensator piston chamber 98 is formed between a first side 101 of the compensator piston portion 94 and the compensator cylinder portion 86, and wherein a second compensator piston chamber 103 is formed between a second side 102 of the compensator piston portion 94 and the compensator cylinder portion 86. The method includes forming a hydraulic port 106 through the housing 30 such that the hydraulic port 106 opens to the first compensator piston chamber 98, and forming a hydraulic via 108 through the compensator cylinder portion 86 to fluidly couple the second compensator piston chamber 103 with the first housing internal chamber, wherein at least the compensator cylinder portion 86 and compensator piston portion 94 comprise a built-in pressure compensator 111.

Advantages of embodiments of the present invention include providing a space-saving configuration by having the pressure compensator 111 built into the housing 30 of the actuator 20. Another advantage of the space-saving and integral design of embodiments of the present invention is simplified installation of the actuator 20. Instead of having to install both an actuator and an external accumulator unit, the installation of a single actuator 20 having a built-in compensator 111 described herein is required. Yet another advantage of embodiments of the present invention is that fewer potential leak locations exist between the actuator 20 and the compensator 111 because there are no external piping joints connecting between the actuator 20 and the compensator 111. An optional relief valve 216 disposed within the second piston portion 294 improves the safety of the actuator 220.

Embodiments of the present invention are particularly useful in subsea applications. In some failsafe actuators, one common problem is failure of the spring due to corrosion caused by exposure to seawater. While seawater may enter portions of the actuator 20 from the control system 120 through ports 80 and 106, because embodiments of the present invention provide a sealed and self-contained hydraulic fluid chamber for the spring 62, the spring 62 is not likely to be exposed to seawater and thus the spring 62 remains submerged in clean hydraulic fluid. This extends the life of the spring 62, improves the reliability of the actuator 20 in harsh environments, such as in subsea applications), and extends the life of the actuator 20. The compensating chamber may be left open to the seawater to sense the hydrostatic head, not requiring the use of a hydraulic line from an external control panel.

It will be appreciated by those skilled in the art having the benefit of this disclosure that an embodiment of the present invention provides a hydraulic actuator with a built-in pressure compensator. It should be understood that the drawings and detailed description herein are to be regarded in an illustrative rather than a restrictive manner, and are not intended to limit the invention to the particular forms and examples disclosed. On the contrary, the invention includes any further modifications, changes, rearrangements, substitutions, alternatives, design choices, and embodiments apparent to those of ordinary skill in the art, without departing from the spirit and scope of this invention, as defined by the following claims. Thus, it is intended that the following claims be interpreted to embrace all such further modifications, changes, rearrangements, substitutions, alternatives, design choices, and embodiments.

What is claimed is:

1. A hydraulic actuator, comprising:

an actuator housing;

a built-in pressure compensator located within the housing, the built-in pressure compensator comprising:

a compensator cylinder portion located within the actuator housing, the compensator cylinder portion being fixed relative to the housing, and the compensator cylinder portion having an internal chamber formed therein, a compensator piston portion slidably fitting within the compensator internal chamber, a first compensator piston chamber being formed between a first side of the compensator piston portion and the compensator cylinder portion within the compensator internal chamber, a second compensator piston chamber being formed between a second side of the compensator piston portion and the compensator cylinder portion within the compensator internal chamber, wherein a compensator hydraulic port is routed through the housing, one end of the hydraulic port opening outside of the housing and another end of the hydraulic port opening to the first compensator piston chamber;

a first housing internal chamber formed within the housing;

a first hydraulic passageway formed through the compensator cylinder portion and fluidly coupling the second compensator piston chamber with the first housing internal chamber;

an operating stem extending into the housing and slidably coupled to the housing, the operating stem being coupleable to a valve;

an actuator cylinder portion slidably fitting within the housing, the actuator cylinder portion having an actuator cylinder internal chamber formed therein with a closed end and an open end, and the actuator cylinder portion being mechanically coupled to the operating stem, wherein the first housing internal chamber is formed between the housing and the actuator cylinder portion at the open end of the actuator cylinder internal chamber, such that the actuator cylinder internal chamber of the actuator cylinder portion opens to the first housing internal chamber;

a spring located within the housing, the spring being biased between the housing and the actuator cylinder portion; and an actuator piston portion located within the housing, being fixed relative to the housing, extending through the open end of the actuator cylinder internal chamber, and slidably fitting into the actuator cylinder internal chamber of the actuator cylinder portion.

2. The actuator according to claim 1, further comprising a stop ring located between the actuator cylinder portion and the housing, the stop ring being positioned so as to limit the displacement of the actuator cylinder portion in one direction.

3. The actuator according to claim 1, wherein the spring is submerged in hydraulic fluid and the volume of hydraulic fluid that the spring is submerged in remains constant and remains sealed within the housing during use of the actuator.

4. The actuator according to claim 1, wherein the spring is strong enough to move the actuator cylinder portion to one of its displacement limits so that the actuator is a failsafe actuator.

5. The actuator according to claim 1, further comprising:

a second housing internal chamber formed within the housing between the housing and an exterior of the actuator cylinder portion;

an actuator piston chamber formed between the actuator piston portion and the actuator cylinder portion within the actuator cylinder internal chamber;

an actuator hydraulic port routing through the actuator piston portion and the housing, one end of the actuator hydraulic port opening outside of the housing and another end of the actuator hydraulic port opening to the actuator piston chamber; and a second hydraulic passageway formed through the actuator cylinder portion and fluidly coupling the first housing internal chamber with the second housing internal chamber.

6. The actuator according to claim 5, further comprising a spring plate ring located about the exterior of the actuator cylinder portion between the spring and the actuator cylinder portion.

7. The actuator according to claim 6, wherein the spring plate ring and the actuator cylinder portion comprise separate pieces, wherein the actuator cylinder portion includes a flange portion extending from the exterior thereof, and wherein the spring plate ring presses against the flange portion of the actuator cylinder portion.

8. The actuator according to claim 6, wherein the spring plate ring is integral to the actuator cylinder portion.

9. The actuator according to claim 5, wherein the spring is located in the second housing internal chamber.

10. The actuator according to claim 5, wherein the housing comprises:

a bonnet portion; and an outer sidewall portion removably attached to the bonnet portion, wherein the actuator piston portion is removably attached to the outer sidewall portion.

11. The actuator according to claim 10, wherein the housing further comprises:

a first seal between the outer sidewall portion and the bonnet portion;

a second seal between the actuator piston portion and the outer sidewall portion;

a packing gland about the operating stem and secured within the bonnet portion;

a first seal ring between the operating stem and the packing gland; and a second seal ring between the packing gland and the bonnet portion.

12. The actuator according to claim 10, further comprising a retainer ring located about the outer sidewall portion and fastened to the bonnet portion, wherein the outer sidewall portion is attached to the bonnet portion using the retainer ring.

13. The actuator according to claim 12, wherein the retainer ring and the outer sidewall portion comprise separate pieces.

14. The actuator according to claim 12, wherein the retainer ring is integral to the outer sidewall portion.

15. The actuator according to claim 10, further comprising:

a first filling port routed within the housing, one end of the first filling port opening outside of the housing and another end of the first filling port opening to the first housing internal chamber; and a second filling port routed within the bonnet portion, one end of the second filling port opening outside of the bonnet portion and another end of the second filling port opening to the second housing internal chamber.

16. The actuator according to claim 1, wherein the housing further comprises:

a cover plate removably attached to the compensator cylinder portion to form an enclosure for the compensator cylinder internal chamber, wherein the compensator hydraulic port is formed through the cover plate; and a third seal between the cover plate and the compensator cylinder portion.

17. The actuator according to claim 1, wherein the housing is filled with hydraulic fluid.

18. A method of producing petroleum, comprising:

coupling the actuator according to claim 1 to a valve; and controlling the flow of petroleum through the valve using the actuator during production operations.

19. A method of compensating for pressure changes and hydraulic fluid displacement within an actuator, comprising:

providing an actuator according to claim 1;

inputting hydraulic fluid into the actuator; and compensating for pressure changes and hydraulic fluid displacement within the actuator using the built-in pressure compensator.

20. The actuator according to claim 1, wherein the compensator piston portion is unrestrained from sliding relative to the compensator cylinder portion within the compensator cylinder internal chamber.

21. The actuator according to claim 1, further comprising a relief valve coupled to the compensator piston portion, wherein the relief valve is fluidly coupled to the second compensator piston chamber.

22. The actuator according to claim 1, further comprising a first filling port routed within the housing, one end of the first filling port opening outside of the housing and another end of the first filling port opening to the first housing internal chamber.

23. A hydraulic actuator, comprising:

an actuator housing;

a built-in pressure compensator located within the housing, the built-in pressure compensator comprising:

a compensator cylinder portion located within the actuator housing, the compensator cylinder portion being fixed relative to the housing, and the compensator cylinder portion having an internal chamber formed therein, a compensator piston portion slidably fitting within the compensator internal chamber, a first compensator piston chamber being formed between a first side of the compensator piston portion and the compensator cylinder portion within the compensator internal chamber, a second compensator piston chamber being formed between a second side of the compensator piston portion and the compensator cylinder portion within the compensator internal chamber, wherein a compensator hydraulic port is routed through the housing, one end of the hydraulic port opening outside of the housing and another end of the hydraulic port opening to the first compensator piston chamber;

a first housing internal chamber formed within the housing; and a first hydraulic passageway formed through the compensator cylinder portion and fluidly coupling the second compensator piston chamber with the first housing internal chamber, wherein the compensator piston portion is unrestrained from sliding relative to the compensator cylinder portion within the compensator cylinder internal chamber.

24. A method of producing petroleum, comprising:

coupling the actuator according to claim 23 to a valve; and controlling the flow of petroleum through the valve using the actuator during production operations.

25. A method of compensating for pressure changes and hydraulic fluid displacement within an actuator, comprising:

providing an actuator according to claim 23;

inputting hydraulic fluid into the actuator; and compensating for pressure changes and hydraulic fluid displacement within the actuator using the built-in pressure compensator.

26. A hydraulic actuator, comprising:

an actuator housing;

a built-in pressure compensator located within the housing, the built-in pressure compensator comprising:

a compensator cylinder portion located within the actuator housing, the compensator cylinder Portion being fixed relative to the housing, and the compensator cylinder portion having an internal chamber formed therein, a compensator piston portion slidably fitting within the compensator internal chamber, a first compensator piston chamber being formed between a first side of the compensator piston portion and the compensator cylinder portion within the compensator internal chamber, a second compensator piston chamber being formed between a second side of the compensator piston portion and the compensator cylinder portion within the compensator internal chamber, wherein a compensator hydraulic port is routed through the housing, one end of the hydraulic port opening outside of the housing and another end of the hydraulic port opening to the first compensator piston chamber;

a first housing internal chamber formed within the housing;

a first hydraulic passageway formed through the compensator cylinder portion and fluidly coupling the second compensator piston chamber with the first housing internal chamber; and a relief valve coupled to the compensator piston portion, wherein the relief valve is fluidly coupled to the second compensator piston chamber.

27. A method of producing petroleum, comprising:

coupling the actuator according to claim 26 a valve; and controlling the flow of petroleum through the valve using the actuator during production operations.

28. A method of compensating for pressure changes and hydraulic fluid displacement within an actuator, comprising:

providing an actuator according to claim 26;

inputting hydraulic fluid into the actuator; and compensating for pressure changes and hydraulic fluid displacement within the actuator using the built-in pressure compensator.

29. A hydraulic actuator for controlling a valve, comprising:

a housing;

an operating stem extending into the housing and slidably coupled to the housing, the operating stem being coupleable to the valve;

a first cylinder portion slidably fitting within the housing, the first cylinder portion having a first cylinder internal chamber formed therein with a closed end and an open end, and the first cylinder portion being mechanically coupled to the operating stem;

a first housing internal chamber formed within the housing between the housing and the first cylinder portion at the open end of the first cylinder internal chamber, such that the first cylinder internal chamber of the first cylinder portion opens to the first housing internal chamber;

a second housing internal chamber formed within the housing between the housing and an exterior of the first cylinder portion;

a spring located within the housing, the spring being biased between the housing and the first cylinder portion;

a first piston portion located within the housing, being fixed relative to the housing, extending through the open end of the first cylinder internal chamber, and slidably fitting into the first cylinder internal chamber of the first cylinder portion;

a first piston chamber formed between the first piston portion and the first cylinder portion within the first cylinder internal chamber;

a second cylinder portion located within the housing, the second cylinder portion being fixed relative to the housing, and the second cylinder portion having a second cylinder internal chamber formed therein;

a second piston portion located within the housing and slidably fitting within the second cylinder internal chamber;

a second piston chamber formed between a first side of the second piston portion and the second cylinder portion within the second cylinder internal chamber;

a third piston chamber formed between a second side of the second piston portion and the second cylinder portion within the second cylinder internal chamber;

a first hydraulic port routing through the first piston portion and the housing, one end of the first hydraulic port opening outside of the housing and another end of the first hydraulic port opening to the first piston chamber;

a second hydraulic port routing through the housing, one end of the second hydraulic port opening outside of the housing and another end of the second hydraulic port opening to the second piston chamber;

a first hydraulic passageway formed through the second cylinder portion and fluidly coupling the third piston chamber with the first housing internal chamber; and a second hydraulic passageway formed through the first cylinder portion and fluidly coupling the first housing internal chamber with the second housing internal chamber.

30. The actuator according to claim 29, wherein the housing comprises:

a bonnet portion;

an outer sidewall portion removably attached to the bonnet portion, wherein the first piston portion is removably attached to the outer sidewall portion;

a first seal between the outer sidewall portion and the bonnet portion;

a second seal between the first piston portion and the outer sidewall portion;

a packing gland about the operating stem and secured within the bonnet portion;

a first seal ring between the operating stem and the packing gland;

a second seal ring between the packing gland and the bonnet portion;

a cover plate removably attached to the second cylinder portion to form an enclosure for the second cylinder internal chamber, wherein the second hydraulic port is formed through the cover plate; and a third seal between the cover plate and the second cylinder portion.

31. The actuator according to claim 29, wherein the spring is submerged in hydraulic fluid and the volume of hydraulic fluid that the spring is submerged in remains constant and remains sealed within the housing during use of the actuator.

32. The actuator according to claim 29, wherein the spring is located in the second housing internal chamber.

33. The actuator according to claim 29, further comprising a relief valve coupled to the second piston portion, wherein the relief valve is fluidly coupled to the third piston chamber.

34. A method of manufacturing an actuator, comprising:

providing an actuator housing;

disposing a compensator cylinder portion within the actuator housing, the compensator cylinder portion being fixed relative to the housing and having a compensator internal chamber formed therein;

slidably fitting a compensator piston portion within the compensator internal chamber, wherein a first compensator piston chamber is formed between a first side of the compensator piston portion and the compensator cylinder portion, wherein a second compensator piston chamber is formed between a second side of the compensator piston portion and the compensator cylinder portion;

forming a hydraulic port through the housing such that the hydraulic port opens to the first compensator piston chamber;

forming a hydraulic passageway through the compensator cylinder portion to fluidly couple the second compensator piston chamber with a first housing internal chamber, wherein at least the compensator cylinder portion and compensator piston portion comprise a built-in pressure compensator;

extending an operating stem into the housing, the operating stem being slidably coupled to the housing, the operating stem being coupleable to a valve;

slidably fitting an actuator cylinder portion within the housing, the actuator cylinder portion having an actuator cylinder internal chamber formed therein with a closed end and an open end, and the actuator cylinder portion being mechanically coupled to the operating stem, wherein the first housing internal chamber is formed between the housing and the actuator cylinder portion at the open end of the actuator cylinder internal chamber, such that the actuator cylinder internal chamber of the actuator cylinder portion opens to the first housing internal chamber;

biasing a spring within the housing between the housing and the actuator cylinder portion; and disposing an actuator piston portion within the housing, the actuator piston portion being fixed relative to the housing, extending through the open end of the actuator cylinder internal chamber, and slidably fitting into the actuator cylinder internal chamber of the actuator cylinder portion.

35. The method according to claim 34, further comprising forming at least one filling port in the actuator housing, and filling the actuator with hydraulic fluid through the at least one filling port.

36. The method according to claim 35, further comprising bleeding the actuator through one said at least one filling port.

37. The method according to claim 34, wherein providing the actuator housing comprises providing a bonnet portion proximate the spring and operating stem, further comprising:

forming a first filling port within the housing, one end of the first filling port opening outside of the housing and another end of the first filling port opening to the first housing internal chamber;

forming a second filling port in the bonnet portion, one end of the second filling port opening outside of the bonnet portion and another end of the second filling port opening to a second housing internal chamber formed within the actuator housing between the actuator housing and an exterior of the actuator cylinder portion; and filling the actuator with hydraulic fluid through the first filling port or the second filling port.

38. The method according to claim 37, further comprising bleeding the actuator through the first filling port or the second filling port.

39. The method according to claim 37, further comprising plugging the first filling port and the second filling port.

* * * * *

UNITED STATES PATENT AND TRADEMARK OFFICE

CERTIFICATE OF CORRECTION

PATENT NO. : 6,783,107 B2
DATED : August 31, 2004
INVENTOR(S) : Chatufale

It is certified that error appears in the above-identified patent and that said Letters Patent is hereby corrected as shown below:

Column 14,
Line 62, replace “Portion” with -- portion --.

Column 15,
Line 23, replace “claim 26 a” with -- claim 26 to a --.

Signed and Sealed this

Eighth Day of February, 2005

JON W. DUDAS
*Director of the United States Patent and Trademark Office*